United States Patent [19]

Wernimont

[11] Patent Number: 4,488,850

[45] Date of Patent: Dec. 18, 1984

[54] COUPLER ASSEMBLY

[75] Inventor: Theodore A. Wernimont, Burlington, Iowa

[73] Assignee: J. I. Case Company, Racine, Wis.

[21] Appl. No.: 409,509

[22] Filed: Aug. 19, 1982

[51] Int. Cl.[3] ..... E02F 3/74

[52] U.S. Cl. ..... 414/723; 414/686; 37/117.5

[58] Field of Search ..... 414/723; 280/461 A, 280/460 A, 456 A; 172/272-275; 37/117.5

[56] References Cited

U.S. PATENT DOCUMENTS

| | | | |
|---|---|---|---|
| 3,204,793 | 9/1965 | Lane . | |
| 3,269,570 | 8/1966 | Wallberg . | |
| 3,319,817 | 5/1967 | Juhl et al. . | |
| 3,818,551 | 6/1974 | Coughran . | |
| 3,876,091 | 4/1975 | MacDonald . | |
| 4,013,182 | 3/1977 | Pratt et al. . | |
| 4,030,624 | 6/1977 | Matthews | 172/272 X |
| 4,116,347 | 9/1978 | Uchida | 414/723 |
| 4,119,225 | 10/1978 | Macht et al. . | |
| 4,136,792 | 1/1979 | Wilson . | |
| 4,204,794 | 5/1980 | Aoshiba . | |
| 4,355,945 | 10/1982 | Pilch | 414/723 X |

*Primary Examiner*—Joseph E. Valenza
*Assistant Examiner*—Terrance L. Siemens
*Attorney, Agent, or Firm*—Dressler, Goldsmith, Shore, Sutker & Milnamow, Ltd.

[57] ABSTRACT

A coupler assembly for a material handling device is provided which accommodates convenient interchanging of work implements. The coupler assembly includes first and second latching arrangements which are provided on a frame member which is adapted to be mounted on the lift arm assembly of material handling device. Notably, the second latching arrangement includes an elongated bar having end portions which are deflectable with respect to the central portion of the bar. A pair of overcenter locking cams are provided for urging the respective end portions of the bar into recesses defined by hooks which are mounted on the implement to be mounted, thus facilitating convenient attachment of the implement to the lift arm assembly.

21 Claims, 3 Drawing Figures

COUPLER ASSEMBLY

TECHNICAL FIELD OF THE INVENTION

This invention relates to coupler assemblies and more particularly to coupler assemblies for attaching implements to lift arms as found on mechanized equipment.

BACKGROUND OF THE INVENTION

Mechanized equipment such as backhoes and tractors having lift arms can be used with various work implements such as buckets, blades, and lift forks. The implement is mounted on the lift arm to facilitate operation and use of the implement. Various mechanisms have been proposed to allow quick interchanging of these work implements so the same tractor can be used for different work functions. Generally, the implement and lift arm are modified or provided with attachment members to releasably mount the various implements on the lift arm to permit quick changing.

Some of these quick change mechanisms rely on pins which must be inserted into aligned holes in the implement and mounting brackets on the lift arm. Unfortunately, this type of mechanism can require careful and time consuming alignment of the holes. The pins often must be particularly robust to prevent misalignment problems and to carry the load of the implement. Additionally, the pins are exposed to dirt and tend to wear unevenly causing undesirable looseness and misalignment in the coupling.

Other mechanisms proposed have relatively large and complicated linkages. These mechanisms consist of a female member mounted on the implement and an expandable male member mounted on the lift arm of the tractor. The male member has a hinge-like structure which is expanded to engage the female member. Such mechanisms often use hydraulic cylinders.

Some of these mechanisms are particularly complex and can offset the balance of the tractor by placing an excessive weight on the end of the lift arm. In addition, the hydraulic system can leak causing the inadvertent disengagement of the implement from the tractor. Other devices have complicated locking mechanisms in a relatively inaccessible location making implement changing difficult for the operator.

Accordingly, it would be desirable to provide a coupler assembly which avoids the deficiencies of the prior art and is easy to use and provides sure coupling of an implement on a lift arm. The present invention meets that desire.

SUMMARY OF THE INVENTION

The present invention is a coupler assembly for attaching various work implements such as a bucket to a lift arm assembly. Such lift arm assemblies can be found on tractors, backhoes, and front end loaders. The coupler assembly of the present invention allows for easy and quick removal of one work implement from the lift arm assembly and the mounting of a different work implement on the lift arm assembly. Thus, the same tractor can serve several functions by simply interchanging the work implement.

The coupler assembly basically comprises an attachment structure on the work implement defining a first recess and a second recess opening in opposite directions. First and second latching means are provided on a frame member which is adapted to be mounted on the lift arm assembly. The first latching means is received by the first recess and the second latching means engages the second recess to attach the implement on the frame member.

The second latching means includes a bar means having a mounting portion mounted on the frame member and an end portion deflectable with respect to the mounting portion. The end portion is adapted to be received by and engage with the second recess. This deflectable motion provides not only ease of operation, but also the certainty of engagement with the second recess. An engaging or camming means can be associated with the bar means for maintaining the end portion engaged with the second recess. In one preferred embodiment the bar means is a resilient bar having a central mounting portion fixed on the frame member and two opposite end portions adapted to be received by the second latching means which can be two hooks each defining a slot. The resiliency of the bar assists in the operation of the coupler assembly.

Because of its design requiring relatively few, light components, the present invention does not offset the balance of the tractor and is also less expensive and easier to produce than many previous devices. The second recess defined by the attachment structure also serves as a guide for the end portion of the bar means to assist in the proper alignment of the work implement on the lift arm. The relative simplicity of the present invention also provides for ease and reliability of operation.

Numerous advantages and features of the present invention will become readily apparent from the following detailed description of the preferred embodiment of the invention, the drawings and the accompanying claims.

DESCRIPTION OF THE PREFERRED EMBODIMENTS

Figure 1:
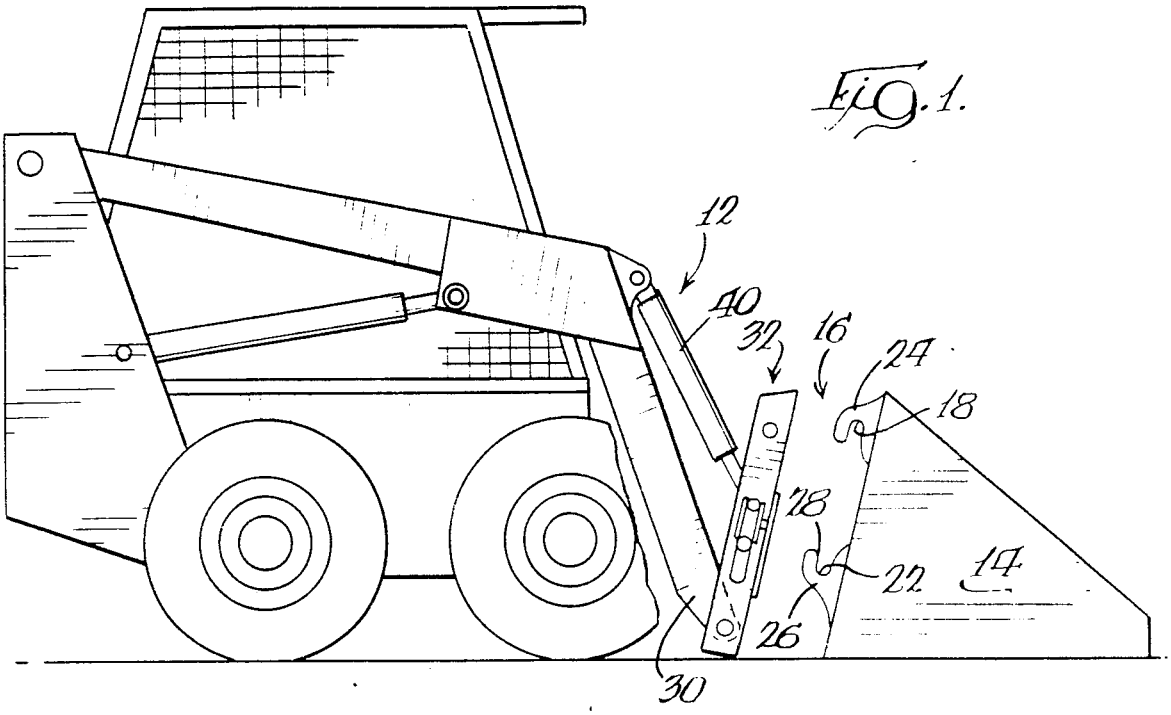
FIG. 1 is a side elevational view of a tractor having a lift arm assembly adjacent a bucket together showing a coupler assembly embodying the present invention.
Figure 2:
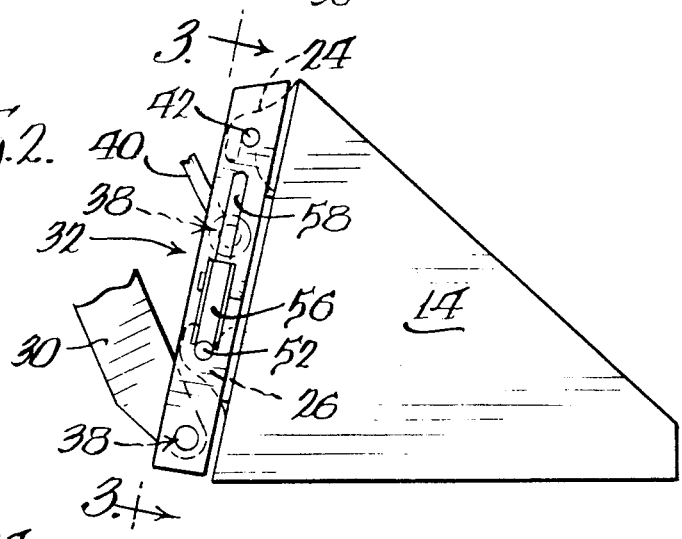
FIG. 2 is an enlarged side elevational view of the coupler assembly.

While this invention can be embodied in many different forms, there is shown in the drawing and described in detail, a preferred embodiment of the invention. The present disclosure is to be considered as an exemplification of the principles of the invention and is not intended to limit the invention to the embodiment illustrated.

For ease of description, the coupler assembly embodying this invention will be described in a normal upright operating position and such terms as upper, lower, upwardly, downwardly, will be used with reference to this position. It will be understood, however, that the coupler assembly embodying this invention can be used in an orientation other than the position described.

Referring to the FIGURES, a tractor having a lift arm assembly 12, and commonly referred to as a skid steer loader, is shown adjacent to a work implement, a bucket 14. The present invention, a coupler assembly, can be used with any piece of mechanized equipment having a lift arm assembly and any type of work implement such as a bucket, blade, or fork assembly.

The bucket 14 is provided with an attachment structure 16 which defines at least one and preferably a pair of first, downwardly facing, recesses 18 and at least one and preferably a pair of second, upwardly facing, recesses 22. For ease of description the first recess is identified as the upper recess and the second recess is identified as the lower recess. These terms can be interchanged or replaced by other terms as desired. The first and second recess which can be defined by any suitable opening, open in opposite directions, i.e., one faces downwardly and one faces upwardly. Preferably the recesses open toward each other as shown in FIG. 1.

The first or downward facing recess 18 is preferably defined by a first or upper hook means such as one or more hooks 24 on the upper portion of the bucket 14. The second or upwardly facing recess 22 is preferably defined by at least one, preferably two second or lower hook means such as spaced apart lower hooks 26 on the lower portion of the bucket 14. Alternatively, the recesses can be defined by any suitable structure and opening including an elongated channel structure. As shown, the attachment structure 16 is defined by the four hooks which are preferably welded on the back of the bucket 14.

The coupler assembly also includes a frame member 32 adapted to be mounted on the lift arm assembly 12. The frame member preferably includes two spaced apart upright channel members 34 which mount on the lift arm assembly 12, and a plate 36 mounted, as by welding, on the channel members. The channel members can be defined by two upright bar members fixed on the plate 36. The channel members 34 and connection means 38 facilitate removably mounting the frame member 32 on lift arm 30 and lift motor 40 of the lift arm assembly 12. The channel members 34, together with the plate 36 also provide structural strength and integrity for mounting with the bucket.

The coupler assembly also includes first or upper latching means such as two upper latch members 42 on the channel members 34 and second or lower latching means including bar means 44. The upper and lower latching means cooperate with the attachment structure 16 and the recesses 18 and 22 to attach the bucket 14 on the frame member 32. The upper latch members 42 are preferably cylindrical and closely fit into the slots or recesses 18. Alternatively, the bar means 44 can be part of the upper latching means.

The bar means 44 includes a central or mounting portion 46 and at least one and preferably two end portions 48 opposite with respect to the central portion. The central or mounting portion is mounted on the frame member 32 as on the central portion of the plate 36. The end portions 48 are adapted to be received by and engage with the lower hooks 26 and the upwardly facing recesses 22. The lower hooks 26 preferably have an elongated slot configuration and a rounded end 28 to guide the bar into the recess.

The bar means is preferably a single round resilient spring steel bar 52 having the central portion 46 fixed on the plate as by retaining block 50 or welding. This prevents rotation of the central portion 46 as first one and then the other end of the bar is locked into position. Alternatively, the bar means 44 can be one or more bars pivotably mounted at the mounting portion 46. The bar means is preferably biased out of engagement with the upwardly facing recesses 22 as shown on the left side of FIG. 3. This biasing is preferably accomplished by the resiliency of the bar, but can also be done with appropriate spring means. Alternatively, the resiliency of the bar can be used to maintain the end portions 48 in engagement with the upwardly facing recesses 22.

The use of a single resilient bar is particularly advantagous. Unlike other devices which have complicated linkages to lock the bucket on the lift arm, the present invention uses a bar which is deflectable in an arcuate path. The bar can even provide its own biasing means. Thus, the present invention accomplishes with one part the same function for which other devices require several. This not only reduces the cost, but also provides easier and more certain operation with fewer breakdowns.

The coupler assembly is preferably provided with engaging means associated with the bar means 44 for maintaining the end portions 48 engaged with the upwardly facing recess 22. This engaging means is preferably a camming means 54 associated with each end portion 48 for driving the end portions into and maintaining the end portions in engagement with the upwardly facing recesses 22. The camming means 54 is preferably a cam 56 rotatably mounted on the frame member plate 36 near the end of the bar 52. This provides the greatest mechanical leverage for the camming means, insuring ease of operation as well as positioning the cam 56 and its handle 58 outside the channel members to provide easy access for the operator.

Figure 3:
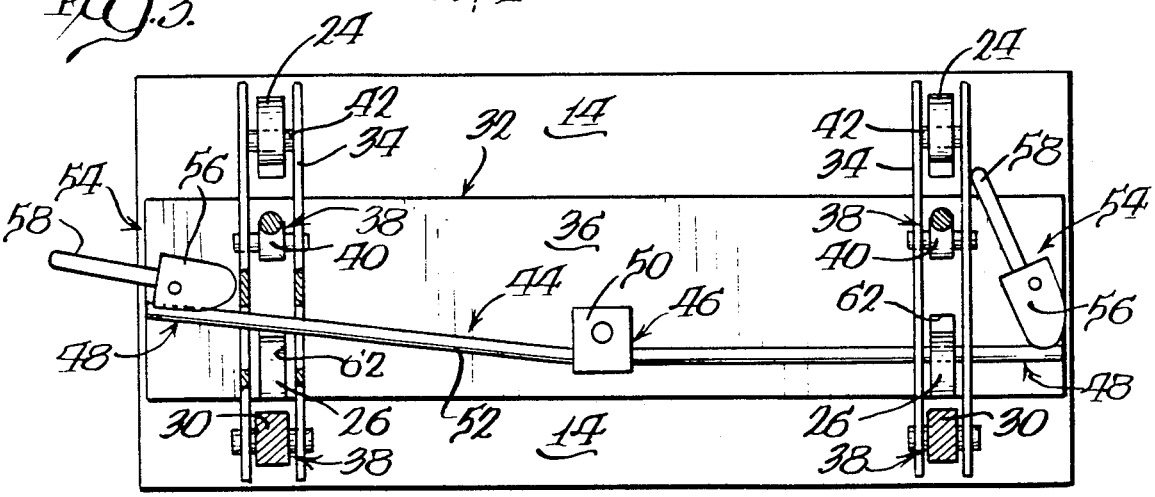
FIG. 3 is a rear elevational view taken generally along plane 3—3 of FIG. 2.

The cams 56 preferably have an over center locking position i.e. lobed to go over center, as shown in the righthand side of FIG. 3 which contacts a stop such as one of the upright channel members 34 to maintain the bar means 44 engaged with the upwardly facing recess 22. The bar means 44 and camming means 54 are preferably mounted on the lift arm assembly side of the plate 36. The frame member plate 36 can define openings 62 through which the lower hooks 26 extend to permit engagement by the bar means.

In operation, the skid steer loader is moved forward and the lift arm assembly 12 positioned so that the upper latch members 42 are received in the downwardly facing recesses 18. The bucket 14 is then raised off the ground on the upper latch members 42 and the bucket pivots on the members so it rests against the frame member plate 36. The lower hooks 26 then extend through the plate openings 62. The operator can then grip the handles 58 to rotate the cams 56 forcing the end portions 48 of the bar 44 into the upwardly facing recesses 22 as shown in the righthand section of FIG. 3. The bucket is then firmly attached to the vehicle and properly aligned for use. To remove the bucket, the cams 56 can be rotated to their unlocked positions as shown in the lefthand portion of FIG. 3, the bucket 14 lowered to the ground and the upper latch members 42 disengaged from the downwardly facing recesses 18.

The foregoing specification is intended as illustrative and is not to be taken as limiting. Still other variations within the spirit and scope of the invention are possible and will readily present themselves to those skilled in the art.

What is claimed is:

1. A coupler assembly for attaching a work implement to a lift arm assembly, the coupler assembly comprising:

(a) a frame member adapted for mounting on the lift arm assembly;

(b) an attachment structure on one of the work implement and the frame member, the attachment structure defining a first recess opening in one direction and a second recess opening in an opposite direction;

(c) first latching means on the other of the implement and frame member, the first laching means for being received by the first recess; and (d) second latching means on the other of the implement and frame member for engaging with the second recess, the second latching means including a bar means having a mounting portion mounted on the other of the implement and frame member and an end portion deflectable with respect to the mounting portion, the end portion being deflectable from a disengaged position to an engaged position by bending flexure of said bar means wherein the end portion is received by and engaged with the second recess; whereby the first latching means and the second latching means cooperate with the attachment structure to releasably attach the implement on the frame member.

2. The coupler assembly of claim 1 wherein the second latching means further includes engaging means associated with the bar means for maintaining the end portion engaged with the second recess.

3. The coupler assembly of claim 2 wherein the bar means is biased out of engagement with the second recess and the engaging means is a camming means mounted on the frame member for driving the end portion of said bar means into engagement and maintaining it in engagement with the second recess.

4. The coupler assembly of claim 3 wherein the camming means is adapted to cooperate with the biased bar means so that the camming means is maintained in an over-center locking condition when the end portion of the bar means is engaged with the second recess.

5. The coupler assembly of claim 1 wherein the bar means is a resilient bar and the mounting portion is fixed on the other of the implement and frame member.

6. The coupler assembly of claim 1 wherein the bar means has two deflectable end portions on opposite sides with respect to the mounting portion, the two end portions being deflectable for engaging with respective second recesses.

7. The coupler assembly of claim 6 wherein the attachment structure includes a first hook defining the first recess and two spaced apart hooks respectively defining said second recesses; each end portion of the bar means engaging respective second recesses.

8. The coupler assembly of claim 1 wherein the first and second recesses open toward each other.

9. The coupler assembly of claim 1 wherein the first recess is an upper recess and the second recess is a lower recess.

10. The coupler assembly of claim 1 wherein the attachment structure is on the work implement and the first and second latching means are on the frame member.

11. The coupler assembly of claim 1 wherein the second recess is a slot.

12. A coupler assembly for attaching a work implement to a lift arm assembly, the coupler assembly comprising:

(a) an upper hook means on the upper portion of the implement and defining a downwardly facing recess;

(b) two spaced apart lower hook means on the lower portion of the implement and each defining an upwardly facing recess;

(c) a frame member adapted to be mounted on the lift arm;

(d) an upper latch member on the frame member adapted to be received in the downwardly facing recess;

(e) bar means having a central portion and two end portions opposite with respect to the central portion, the central portion being mounted on the frame member and each end portion being deflectable in an arcuate path with respect to the central portion from a disengaged position to an engaged position by bending flexure of said bar means to be received by and engage with respective upwardly facing recesses; and (f) two camming means on the frame member and respectively associated with each end portion for driving the end portions into, and maintaining the end portions in engagement with the upwardly facing recesses and together with the upper hook means and upper latch member attaching the implement on frame member.

13. The coupler assembly of claim 12 wherein the bar means is a resilient bar and the central portion is fixed on the frame member.

14. The coupler assembly of claim 12 including another upper hook means on the upper portion of the implement defining another downwardly facing recess, and a second upper latch member on the frame member, the upper latch members being respectively received in the downwardly facing recesses as the implement is attached on the frame member.

15. The coupler assembly of claim 12 wherein the frame member includes two spaced apart upright channel members adapted to be mounted on the lift arm assembly, and a plate mounted on the channel members.

16. The coupler assembly of claim 15 wherein the camming means are mounted on the plate outside of the channel members.

17. A coupler assembly for attaching a work implement to a lift arm assembly, the coupler assembly comprising:

(a) an attachment structure on the work implement;

(b) a frame member adapted for mounting on the lift arm assembly, and (c) latching means for releasably mounting said attachment structure on the frame member including bar means including a mounting portion mounted on one of the attachment structure and the frame member, and recess means defined by the other of the attachment structure and frame member, the bar means including an end portion deflectable with respect to the mounting portion, the end portion being deflectable from a disengaged position to an engaged position by bending flexure of said bar means wherein the end portion is received within the recess means for releasably attaching the implement to the frame member.

18. The coupler assembly of claim 17, wherein the latching means further includes engaging means mounted on the one of the attachment structure and frame member on which the bar is mounted, the engaging means being adapted to cooperate with the bar means for releasably maintaining the bar means in engagement with the recess means.

19. The coupler assembly of claim 18 wherein the engaging means comprises cam means movable between first and second positions whereby in the first position of the cam means, the bar means is disengageable from the recess means, and in the second position, the cam means engages the bar means to maintain the bar means in engagement with the recess means.

20. A coupler assembly for attaching a work implement to a lift arm assembly, the coupler assembly comprising:

(a) an upper hook means on the upper portion of the implement and defining a downwardly facing recess;

(b) two spaced apart lower hook means on the lower portion of the implement and each defining an upwardly facing recess;

(c) a frame member adapted to be mounted on the lift arm;

(d) an upper latch member on the frame member adapted to be received in the downwardly facing recess;

(e) bar means having a central portion and two end portions opposite with respect to the central portion, the central portion being mounted on the frame member and each end portion being deflectable in an arcuate path with respect to the central portion to be received by an engage with respective upwardly facing recesses; and (f) two camming means on the frame member and respectively associated with each end portion for driving the end portions into, and maintaining the end portions in engagement with the upwardly facing recesses and together with the upper hook means and upper latch member attaching the implement on frame member, the coupler assembly including two stops on the frame member and wherein the camming means is a cam rotatably mounted on the frame member, the cam having an over center position in contact with the stop to maintain the bar means engaged with the upwardly facing slots.

21. A coupler assembly for attaching a work implement to a lift arm assembly, the coupler assembly comprising:

(a) an upper hook means on the upper portion of the implement and defining a downwardly facing recess;

(b) two spaced apart lower hook means on the lower portion of the implement and each defining an upwardly facing recess;

(c) a frame member adapted to be mounted on the lift arm;

(d) an upper latch member on the frame member adapted to be received in the downwardly facing recess;

(e) bar means having a central portion and two end portions opposite with respect to the central portion, the central portion being mounted on the frame member and each end portion being deflectable in an arcuate path with respect to the central portion to be received by and engage with respective upwardly facing recesses; and (f) two camming means on the frame member and respectively associated with each end portion for driving the end portions into, and maintaining the end portions in engagement with the upwardly facing recesses and together with the upper hook means and upper latch member attaching the implement on frame member, the frame member including two spaced apart upright channel members adapted to be mounted on the lift arm assembly, and a plate mounted on the channel members, the upper latch member being on at least one of the channel members and the camming means and bar means being mounted on the side of the plate adaptd to face the lift arm assembly, the plate also defining two openings for the lower hook means to extend through the plate and be engaged by the bar means.

* * * * *